US009756914B2

(12) United States Patent
Baker et al.

(10) Patent No.: US 9,756,914 B2
(45) Date of Patent: Sep. 12, 2017

(54) CASE FOR A PORTABLE ELECTRONIC DEVICE

(71) Applicant: Apple Inc., Cupertino, CA (US)

(72) Inventors: John J. Baker, Cupertino, CA (US); Edward L. Siahaan, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 50 days.

(21) Appl. No.: 14/609,403

(22) Filed: Jan. 29, 2015

(65) Prior Publication Data

US 2016/0058146 A1 Mar. 3, 2016

Related U.S. Application Data

(63) Continuation of application No. PCT/US2015/013563, filed on Jan. 29, 2015.

(60) Provisional application No. 62/045,480, filed on Sep. 3, 2014.

(51) Int. Cl.
*A45C 11/00* (2006.01)

(52) U.S. Cl.
CPC ..... *A45C 11/00* (2013.01); *A45C 2011/002* (2013.01)

(58) Field of Classification Search
CPC ..... A45C 2011/002; A45C 2011/003
See application file for complete search history.

(56) References Cited

U.S. PATENT DOCUMENTS 6,926,856 B2 * 8/2005 Hus ..... B29C 45/0046 264/257
8,245,842 B2 * 8/2012 Bau ..... H04B 1/3888 206/305
9,136,897 B2 * 9/2015 Hynecek ..... H04B 1/3888
9,307,816 B2 * 4/2016 Sartee ..... A45C 11/00
2011/0036876 A1 2/2011 Fathollahi
2011/0228458 A1 9/2011 Richardson et al.
2013/0092576 A1 4/2013 Rayner
2013/0233762 A1 9/2013 Balaji et al.
2015/0062787 A1 * 3/2015 Wilson ..... H04M 1/185 361/679.01

(Continued)

FOREIGN PATENT DOCUMENTS

KR 20120101912 9/2012

OTHER PUBLICATIONS

PCT Application No. PCT/US2015/013563—International Search Report & Written Opinion dated May 26, 2015.

*Primary Examiner* — Anthony Stashick
*Assistant Examiner* — Mollie Impink
(74) *Attorney, Agent, or Firm* — Downey Brand LLP

(57) ABSTRACT

A case for an electronic device is disclosed. The case may include several layers. An inner layer may be made from a rigid material such as plastic. An outer layer is molded to an exterior portion of the inner layer. A fabric layer formed from a material such as microfiber is adhesively secured to an interior layer of the inner layer, the inner layer opposite the exterior layer. The inner layer may further include a recessed portion that receives a camera trim made from an opaque material. In this regard, when the electronic device is positioned within the case, the camera trim improves image capturing of a camera of the electronic device by blocking reflected light from a camera flash emitted by the electronic device.

18 Claims, 15 Drawing Sheets

(56) References Cited

U.S. PATENT DOCUMENTS

| | | | | |
|---|---|---|---|---|
| 2015/0065208 | A1* | 3/2015 | Balaji | H04M 1/04<br>455/575.8 |
| 2015/0189963 | A1* | 7/2015 | Lai | A45C 13/008<br>224/191 |

* cited by examiner

CASE FOR A PORTABLE ELECTRONIC DEVICE

CROSS-REFERENCE TO RELATED APPLICATION(S)

This is a continuation of International Application PCT/US15/13563, with an international filing date of Jan. 29, 2015, entitled "Case for a Portable Electronic Device," published as WO 2016/036407 on Mar. 10, 2016, which claims the benefit of priority under 35 U.S.C §119(e) to U.S. Provisional Application No. 62/045,480, filed on Sep. 3, 2014, the disclosure of which is incorporated herein by reference in its entirety.

FIELD

The described embodiments relate generally to an accessory for portable electronic devices. In particular, the present embodiments relate to a case capable of receiving a portable electronic device and provide protection thereto.

BACKGROUND

A case can be configured to receive an electronic device. The case may offer means for protecting the device in a drop event and/or provide an aesthetic appearance to the device.

SUMMARY

In one aspect, a method for forming a case for an electronic device is described. The method may include securing a first layer to a second layer. In some embodiments, the first layer includes a first aperture. Also, the second layer may include a recessed portion and a second aperture within the recessed portion. Further, the second layer may include a sidewall having a third aperture. The method may further include securing an intermediate layer within the recessed portion. In some embodiments, the intermediate layer includes a third aperture approximately concentric with respect to the first aperture and the second aperture. The method may further include securing the second layer to a third layer. In some embodiments, the third layer may include a first protrusion and a second protrusion. The first protrusion and the second protrusion may be positioned within the third aperture.

In another aspect, a case for an electronic device is described. The case may include a first layer having a first aperture. The first layer may be configured to engage the electronic device. The case may further include a second layer having a sidewall having a second aperture. The second layer may further include a recessed portion and a third aperture positioned within the recessed portion. The case may further include an intermediate layer positioned within the recessed portion. In some embodiments, the intermediate layer includes a fourth aperture. The case may further include a third layer formed on an exterior portion of the second layer. In some embodiments, the third layer includes a sidewall having a protrusion. In some cases, the first aperture, the third aperture, and the fourth aperture may be approximately concentric with respect to each other. In some cases, the protrusion is positioned within the second aperture. The protrusion may include extension which extends through an aperture of the second layer to engage the first layer. Also, adhesive layers may be used, for example, to secure the first layer to the second layer or secure the intermediate layer to the second layer.

In another aspect, a method for forming a case for an electronic device is described. The method may include forming a first aperture in a first layer. The method may further include molding a second layer in a mold cavity. In some embodiments, molding the second layer includes: molding a recessed portion into the second layer, and forming a second aperture in the recessed portion. In some cases, the second aperture is concentric with respect to the first aperture. The method may further include positioning an intermediate layer within the recessed portion. The method may further include adhesively securing the first layer to the second layer. The method may further include adhesively securing the intermediate layer to the second layer. The method may further include molding a third layer to the second layer. In some embodiments, the third layer includes a third protrusion concentric with the first protrusion and the second protrusion.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
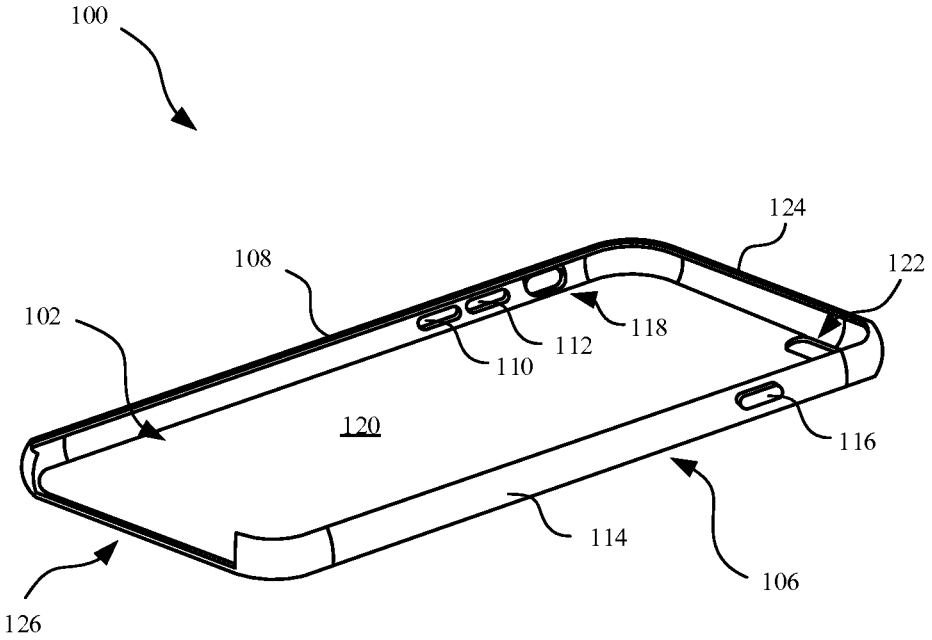
FIG. 1 illustrates an embodiment of a case fully assembled and configured to receive an electronic device.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

The following disclosure relates to a case configured to receive an electronic device. The case offers protection to the electronic device against scratching, and in some cases, protects against damage to the electronic device that may occur from a drop event. Unlike typical cases, the embodiments of the case shown and described herein include several features. For example, the case may include a first layer, a second layer, and a third layer, all of which are formed individually. The second layer may form the general shape of the case and be formed from a rigid material such as plastic to provide support and protection to the electronic device. Also, a region of the second layer may be formed by an undercut molding process. Further, the second layer may include a recessed portion that receives a camera trim. In this manner, when the electronic device uses a camera to capture an image, the camera trim prevents extraneous camera flash generated from the electronic device from entering through the camera, thereby improving image capture. The camera trim is generally formed from an opaque material.

The first layer may be positioned on an interior portion of the second layer and formed from relatively soft materials such as microfiber, or another material that does not scratch an electronic device. The third layer may be formed on an exterior portion of the second layer by a molding process, such as over molding. The third layer may be formed from materials such as an elastomeric silicone, including liquid silicone rubber ("LSR"). Also, the third layer may be one of several colors.

These and other embodiments are discussed below with reference to FIGS. 1-20. However, those skilled in the art will readily appreciate that the detailed description given herein with respect to these Figures is for explanatory purposes only and should not be construed as limiting.

FIG. 1 illustrates an embodiment of case 100 fully assembled and configured to receive an electronic device, such as a mobile telecommunications device (e.g., smartphone) or a tablet computing device. Case 100 may include first layer 102 positioned on an interior portion of a second layer (not shown). In some embodiments, first layer 102 is a formed from a fabric, such as microfiber. Also, case 100 may further include third layer 106 formed on an exterior portion of the second layer. In some embodiments, third layer 106 is made from an elastomeric material, such as silicone. When silicone is used, the silicone may be a liquid silicone rubber ("LSR"). In some embodiments, the silicone is a gum silicone, such as a heat cure rubber ("HCR"). Further, third layer 106 may be combined with the second layer by an over molding process. In other words, once the second layer is molded (or formed by another means), the second layer may be positioned in a molding tool, such as a pair of mating molds. Then, a silicone-based material is added to the molding tool such that the material flows around an exterior portion of the second layer and cures around the exterior portion. Also, first layer 102 may include features which improve lamination of first layer 102 to other layers. This will be further discussed.

Also, case 100 may include apertures and protrusions on various portion of case 100 which allow a user to operate the electronic device when the device is positioned within case 100. For example, case 100 may include first sidewall 108 having first protrusion 110 and second protrusion 112. In some embodiments, first protrusion 110 and second protrusion 112 are formed during a stamping process. In the embodiment shown in FIG. 1, first protrusion 110 and second protrusion 112 are formed during a molding process, such as an over molding process. Generally, first protrusion 110 and second protrusion 112 may be positioned on any sidewall of case 100 in a location corresponding to a control input (e.g., button) or inputs of an electronic device. Also, first protrusion 110 and second protrusion 112 may provide a protective cover to the control inputs to protect against environmental conditions. FIG. 1 further shows second sidewall 114 including third protrusion 116 which may correspond to yet another input of the electronic device.

First sidewall 108 may also include aperture 118 configured to allow access to a switch or an additional control input of the electronic device. Aperture 118 may be positioned on any sidewall of case 100 in a location corresponding to a switch or button of the electronic device.

Case 100 may also include rear portion 120 on which the electronic device may be positioned. As shown in FIG. 1, rear portion 120 includes aperture 122 which may be positioned to allow a camera built into an electronic device to capture an image of the environment surrounding the electronic device. Similar to the protrusions and other apertures previously described, aperture 122 may generally be in any position on rear portion 120 that corresponds to the positioning of the camera within the electronic device such that the camera may capture an image.

Case 100 may further include chin portion 126 associated with a region of case 100 that allows access to features of an electronic device, such as a jack to receive for an audio accessory (e.g., headphones) as well as a jack that receives a power cord in order to supply power to the electronic device. Further, chin portion 126 may be designed around a speaker grill to allow the electronic device to emit audio sounds, such as music or a ring tone, without disruption from case 100. Despite chin portion 126 generally being a region free of material, first sidewall 108, second sidewall 114, and third sidewall 124 may collectively retain an electronic device while also allowing for flexibility to insert and remove the electronic device. The sidewalls, coupled with rear portion 120 and chin portion 126, define an interior cavity that receives the electronic device.

Figure 2:
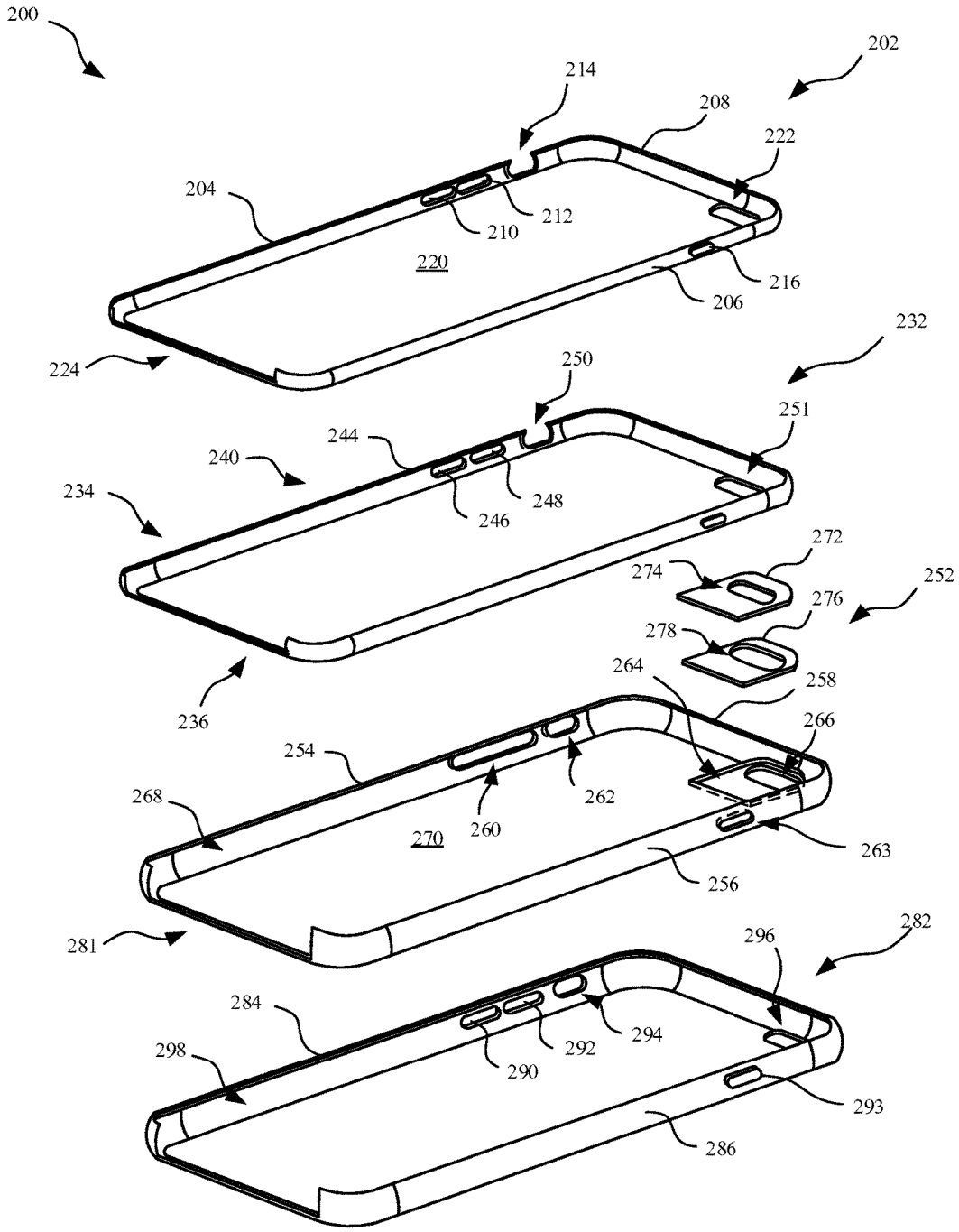
FIG. 2 illustrates an exploded view of an embodiment of a case showing the various layers of the case.

FIG. 2 illustrates an exploded view of case 200 showing various layers, in accordance with the described embodiments. Case 200 may include, for example, first layer 202, adhesive layer 232, second layer 252, and third layer 282. First layer 202 may be a relatively smooth layer free of rough surfaces or edges, and configured to engage the electronic device when positioned within case 200. In some embodiments, first layer 202 is a fabric layer, such as microfiber. First layer 202 further includes several sidewalls, such as first sidewall 204, second sidewall 206, and third sidewall 208. In some embodiments, first sidewall 204 includes preformed features. In the embodiment shown in FIG. 2, first sidewall 204 includes first protrusion 210 and second protrusion 212, both of which are formed during a molding process. Also, in some embodiments, first sidewall 204 includes first aperture 214 that may be formed by a material removal process such as a computer numeric control ("CNC") tool, a die cut tool, or a laser cutting tool. First protrusion 210, second protrusion 212, and first aperture 214 are generally formed in locations corresponding to control input features of an electronic device, such as a button or switch. Second sidewall 206 may also include third protrusion 216 formed in a manner similar to that of first protrusion 210 and second protrusion 212. Also, first layer 202 includes rear portion 220 configured to receive a rear portion of an electronic device. Rear portion 220 may include second aperture 222 formed in rear portion 220 in a location that corresponds to a camera of an electronic device. Also, first layer 202 may include chin portion 224 located in a region associated with several interface features of an electronic device to receive an accessory such as an audio jack, a power jack, or a microphone. Chin portion 224 may further define an opening for a speaker grill of the electronic device. Chin portion 224 may be formed in a manner that exposes the aforementioned interface features. Also, in some cases, first layer 202 includes dimensions which extend beyond chin portion 224. In these, when the layers shown in FIG. 2 are assembled, a laser cutting tool may be used to remove excess material such that an outer peripheral portion of first layer 202 is substantially co-planar, or flush, with respect to chin portion 281 of second layer 252.

In order to secure an outer region of first layer 202 to second layer 252, adhesive layer 232 may be positioned between first layer 202 and second layer 252. Adhesive layer 232 may include an adhesive surface on both a first portion 234 and a second portion 236 opposite the first portion 234. First portion 234 and second portion 236 generally refer to exterior surfaces of adhesive layer 232. This also includes sidewalls 240, such as first sidewall 244. In some embodiments, adhesive layer 232 includes a pressure sensitive adhesive ("PSA"). In some embodiments, adhesive layer 232 is an assembly adhesive or assembly laminate. Also, adhesive layer 232 is configured to conform to the shape and design of first layer 202 and second layer 252. This includes, for example, first sidewall 244, first protrusion 246, second protrusion 248, and first aperture 250. Also, second aperture 251 may be concentric, or approximately concentric, with respect to second aperture 222 and also have similar dimensions. However, in some cases, second aperture 251 of adhesive layer 232 includes larger dimensions. In this manner, adhesive layer 232 will not flow into second aperture 222 or third aperture 266 (of second layer 252).

Second layer 252 may be positioned between first layer 202 and third layer 282, and may be formed from rigid materials, such as plastic. Other materials used to form second layer 252 include nylon 12, polycarbonate (including EX-CEL© polycarbonate), or a combination thereof. Generally, second layer 252 is relatively rigid as compared to first layer 202 and third layer 282. As a result, second layer 252 may provide the overall structural backbone of case 200. In order to form second layer 252, these materials may be in a molten or liquid state and poured in a mold cavity which may combine with a second mold feature. Also, the mold cavity and second mold feature may combine to form an undercut molded region (shown later) first sidewall 254, second sidewall 256, and third sidewall 258. Undercut molding may form, for example, a lip region of second layer 252 near a top portion of the sidewalls that prevents second layer 252 from being directly removed from the mold cavity and/or second mold feature.

Second layer 252 includes various features, some of which are preformed and some of which are formed from a material removal process. For example, first sidewall 254 includes first aperture 260 and second aperture 262, both of which are formed during the molding process for second layer 252. In other words, the mold cavity and/or second molded feature can include a shape configured to preform first aperture 260 and second aperture 262 during a curing process of second layer 252. However, in other embodiments, first aperture 260 and second aperture 262 are formed from a material removal process, such as die cutting, or CNC cutting. First aperture 260 may include dimensions capable of receiving features such as first protrusion 210 and second protrusion 212. Second aperture 262 may be aligned with other features such as first aperture 250 as well as include dimensions capable of receiving a control input (e.g., switch, button) to the electronic device. Second sidewall 256 includes third aperture 263 that may be formed by any means previously described for first aperture 260 and second aperture 262.

In some embodiments, second layer 252 further includes recessed portion 264 having third aperture 266. Recessed portion 264 may be formed during the molding process of second layer 252, and will be discussed later. Also, as shown in FIG. 2, recessed portion 264 may extend at least partially into third sidewall 258. However, in other embodiments, recessed portion 264 is fully enclosed by rear portion 270 of second layer 252. While third aperture 266 may be formed during the molding process of second layer 252 and recessed portion 264, in the embodiment shown in FIG. 2, third aperture 266 is die cut in a subsequent step. Also, third aperture 266 may be concentric, or approximately concentric, with respect to second aperture 222 and also have similar dimensions.

Also, recessed portion 264 may be configured to receive intermediate layer 272. In some embodiments, intermediate layer 272 is used as a camera trim configured to prevent reflected light from, for example, a camera flash event during an image capture of the camera previously described. In this regard, intermediate layer 272 is generally opaque and includes a dark color, such as black. However, in a particular embodiment, intermediate layer 272 is opaque but white in color. This assists in reflecting light incident on case 200 such that intermediate layer 272 is less visible (or not visible) when, for example, third layer 282 includes a pink and/or fluorescent color, as the material or materials used to form those colors are relatively transparent. Although intermediate layer 272 is shown generally as a four-sided figure, intermediate layer 272 could include any number of sides, or intermediate layer 272 could be circular. Accordingly, recessed portion 264 and adhesive layer 276 can also include a shape corresponding to the shape of intermediate layer 272.

Intermediate layer 272 may include aperture 274 that may be concentric, or approximately concentric, with respect to third aperture 266 and also have similar dimensions. In order to secure intermediate layer 272 to recessed portion 264, adhesive layer 276 may be used. Adhesive layer 276 includes an adhesive on multiple surfaces. Also, adhesive layer 276 includes aperture 278 that may be concentric, or approximately concentric, with respect to third aperture 266 and aperture 274, and also have similar dimensions. However, in some cases, aperture 278 of adhesive layer 276 includes larger dimensions. In this manner, adhesive layer 276 will not flow into third aperture 266 or aperture 274. Generally, adhesive layer 276 may be formed from any material previously described for adhesive layer 232. Also, in some embodiments, adhesive layer 276 is foam adhesive.

First layer 202 and adhesive layer 232 are both designed to be positioned within interior cavity 268 of second layer 252. Moreover, second layer 252 is designed to be positioned within an interior cavity 298 of third layer 282. In some embodiments, third layer 282 is formed over second layer 252 during an over molding process in which second layer 252 is placed within a mold cavity (not shown) having dimensions larger than second layer 252. Further, the mold cavity is configured to receive a liquid and allow this liquid form to flow or extend around an exterior portion of second layer 252. A curing process of the liquid forms third layer 282. The mold cavity may further include protrusions which correspond to several protrusions of third layer 282, such as first protrusion 290 and second protrusion 292 located on first sidewall 284. In other words, the protrusions of third layer 282 may be formed during the over molding process. Similarly, second sidewall 286 may include third protrusion 293. The mold cavity may also include other features which allow for openings, such as first aperture 294 and second aperture 296, such that the openings of third layer 282 may be formed during the over molding process. Also, second aperture 296 may be configured to be concentric with respect to second aperture 222 of first layer 202 as well as third aperture 266 of second layer 252.

In some embodiments, third layer 282 is a thermoplastic elastomer (TPE). In the embodiment shown in FIG. 2, third layer 282 is a silicone-based material, such as LSR. In some embodiments, third layer 282 is selected from several colors, including, red, blue, green, yellow, or a combination thereof. In other embodiments, third layer 282 is selected from black, gray, white, or a combination thereof. Also, not shown, in some embodiments, an additional layer, such as a coating, may be formed over third layer 282. The coating may cover or mask certain blemishes associated with the manufacturing process of case 200. The coating may include materials such as TPE, nitrile rubber, silicone, or a combination thereof. It will be appreciated that any features, geometries, and/or orientations previously described may be present in the foregoing embodiments.

Figure 3:
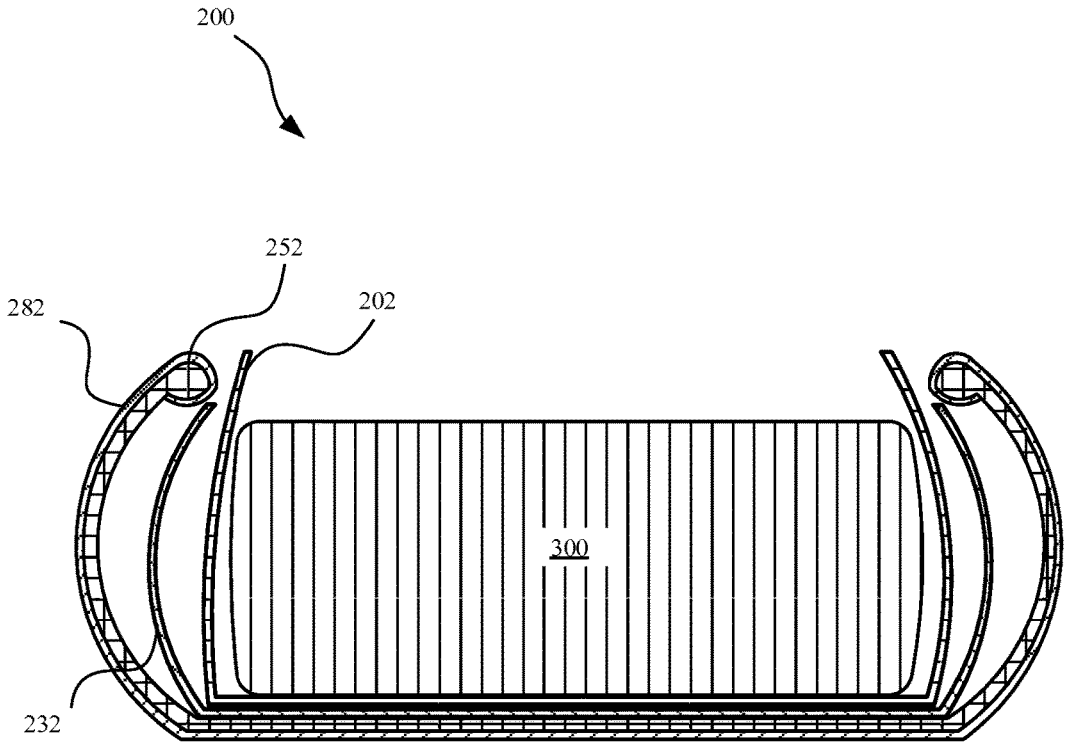
FIG. 3 illustrates a cross sectional view showing an expandable member configured to assemble a case having a first layer, adhesive layer, second layer, and a third layer, in accordance with the described embodiments.
Figure 4:
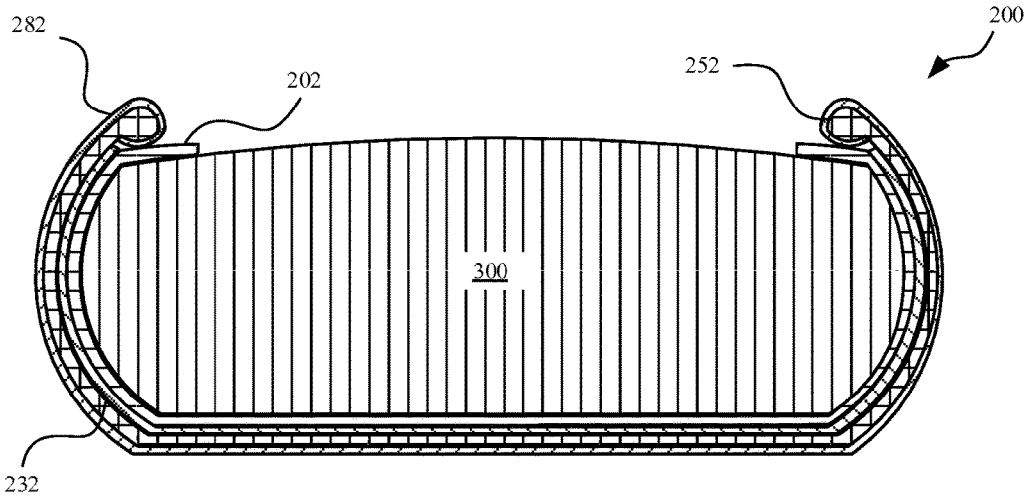
FIG. 4 illustrates an embodiment of an expandable member expanding from a first volume to a second volume such that a first layer is actuated toward an adhesive layer, and both the first layer and the adhesive layer are actuated toward the sidewalls of a second layer.
Figure 5:
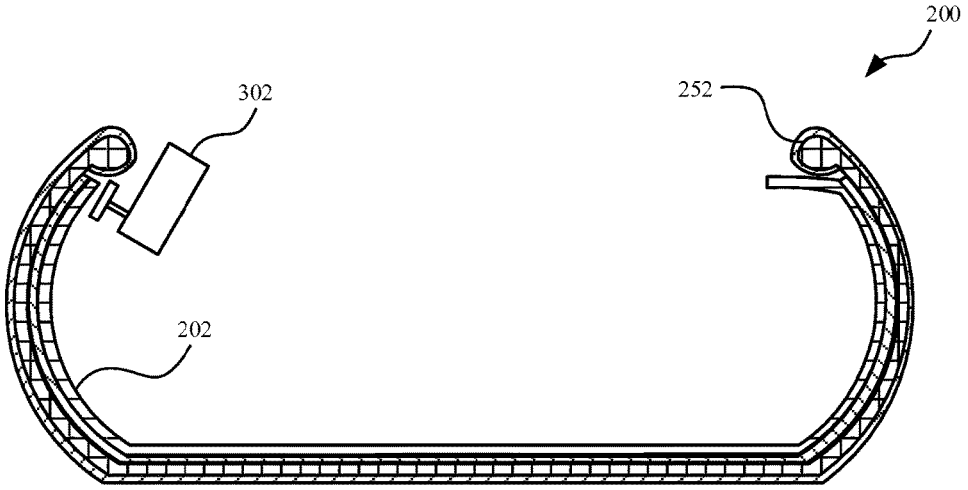
FIG. 5 illustrates the embodiment shown in FIG. 4, further showing a removal tool cutting a portion of a first layer of the case.

When adhesively securing layers, it is relatively less complex to adhesively secure flat or level surfaces. However, non-linear or curved surfaces may require more complexity. FIGS. 3-5 illustrate an assembly process for forming case 200, and in particular, adhesively securing layers in locations associated with the non-linear surfaces, such as sidewalls. FIG. 3 illustrates a cross sectional view of case 200 having first layer 202, adhesive layer 232, second layer 252, and third layer 282. Expansion member 300 may be placed within an interior portion of case 200, and in particular first layer 202, and expanded across a rear portion (e.g., rear portion 220, shown in FIG. 2). Expansion member 300 may also be referred to as a bladder, and further, is generally a non-rigid member. Expansion member 300 may be configured to expand when filled with a liquid or gas, or when a gas is heated. As shown in FIG. 4, expansion member 300 is expanded from a first volume to a second volume greater than the first volume such that first layer 202 is actuated toward adhesive layer 232, and both first layer 202 and adhesive layer 232 are actuated toward the sidewalls of second layer 252. In this manner, case 200 may include non-linear surfaces (e.g., sidewalls) with layers adhesively secured in a desired manner.

Once first layer 202 is adhesively secured to second layer 252, expansion member 300 may be removed. When first layer 202 includes excess material, it can also be removed by a removal tool. FIG. 5 illustrates removal tool 302 cutting a portion of first layer 202. In some embodiments, removal tool 302 is a laser cutting tool. In the embodiment shown in FIG. 5, removal tool 302 is a CNC tool capable of cutting around the outer peripheral portion of first layer 202.

Figure 6:
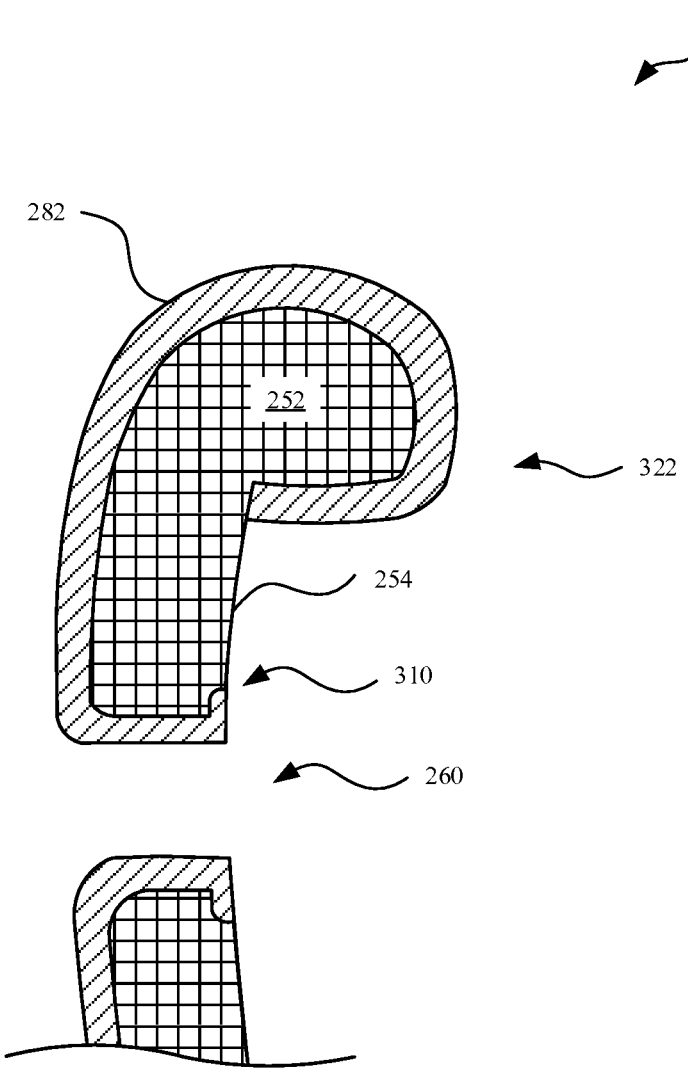
FIG. 6 illustrates a cross sectional view of an embodiment of a case having cuts in portions of an aperture in the second layer, the cuts defining a material removal region.

While an over molding process may promote adhesion between layers (such as second layer 252 and third layer 282, FIG. 2), additional techniques may be incorporated to further promote adhesion. FIG. 6 illustrates a cross sectional view of an enlarged portion of an embodiment of case 200 having cuts in second layer 252. For example, first aperture 260 includes a cut that defines a material removal region 310 of second layer 252 extending around the outer peripheral portion of first aperture 260. As a result, during the over molding process of molding third layer 282 to second layer 252, third layer 282 may flow into the material removal region 310. This allows for improved lamination of third layer 282 to second layer 252. Although FIG. 6 shows relief cuts for first aperture 260, these relief cuts may be used in other apertures, such as third aperture 266. In some embodiments, a removal tool (not shown) may be used to create the material removal region 310. The removal tool may be a CNC tool. In other embodiments, the mold member used to form second layer 252 include indentions that define the material removal region 310.

Also, second layer 252 may include lip region 322 that provides added securing means for an electronic device within case 200. In some embodiments, lip region 322 is machined by a removal tool previously described. In the embodiment shown in FIG. 6, lip region 322 is created by a molding process (e.g., when molding second layer 252). As shown, lip region 322 includes a relatively flat surface as opposed to the curved surface of lip region 322 in other locations. Accordingly, a portion of third layer 282 may also be relatively flat. This relatively flat region of both third layer 282 and lip region 322 define a mechanical interlock which further increases adhesion between third layer 282 and second layer 252. Also, during the molding process of third layer 282, several slides may be inserted into the molding tool and engaged with first sidewall 254. A clearance region between the slides and second layer 252 can contribute to forming the flat region of lip region 322.

Figure 7:
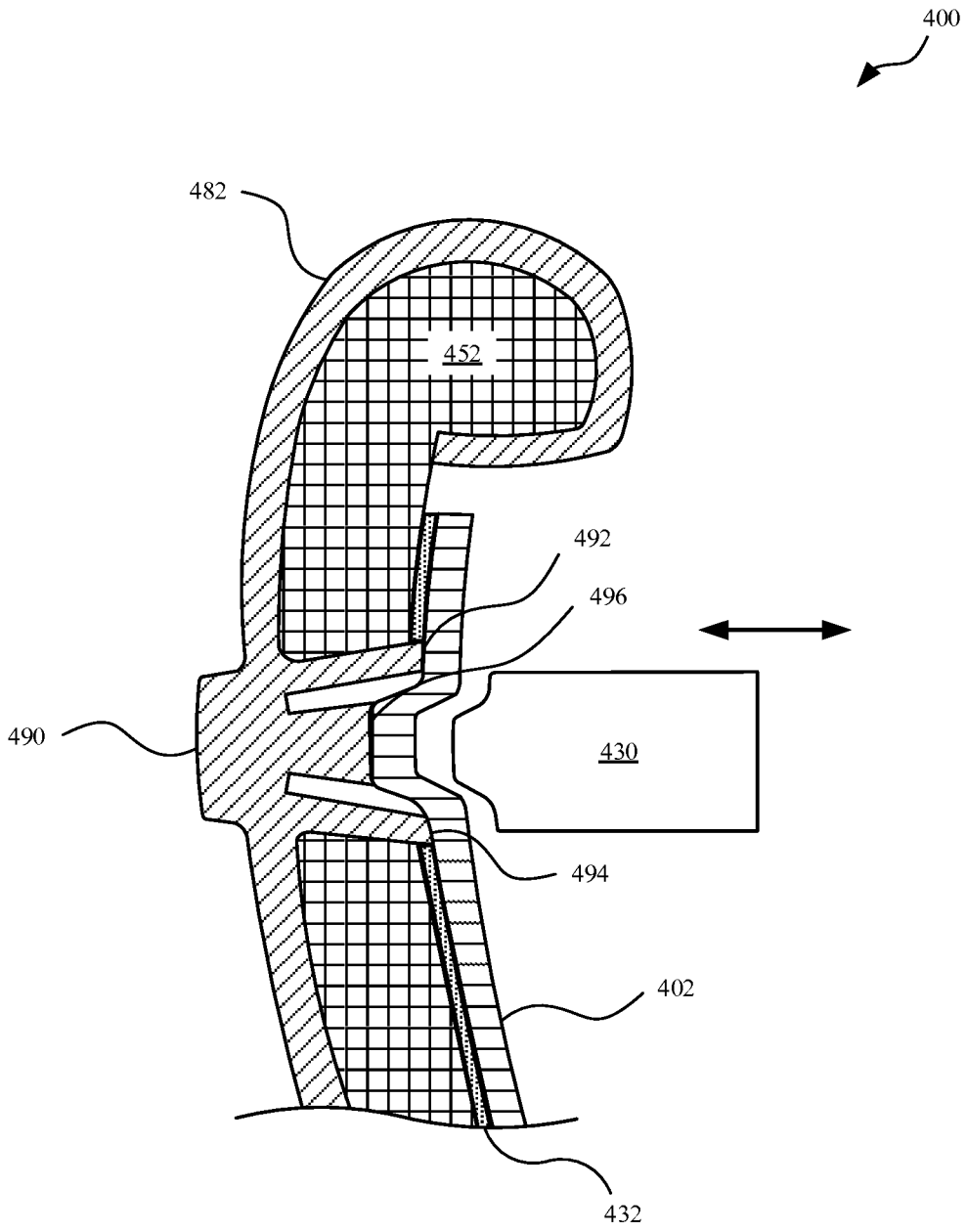
FIG. 7 illustrates a cross sectional view of a case having a third layer with a protrusion with features configured to improve the ability to depress a control input when the electronic device is positioned with case, in accordance with the described embodiments.

A case may also accommodate an electronic device having control input, such as a button, which can be depressed in order to send a signal to the electronic device. FIG. 7 illustrates a cross sectional view of an enlarged portion of an embodiment of case 400 having third layer 482 with protrusion 490 with features configured to improve the ability to depress a control input (e.g., button) when the electronic device is positioned with case 400. For example, first layer 402 may be de-bossed, or indented, by tool 430 into a location proximate to protrusion 490. Tool 430 may also be referred to as a stamping tool as first layer 402 is pressed in a manner such that first layer 402 engages several locations of protrusion 490, including first extension 492, second extension 494, and third extension 496. As shown, first extension 492, second extension 494, and third extension 496 extend through an aperture of second layer 452. These extensions may be formed by a material removal tool, such as a CNC tool, subsequent to an over molding process previously described. Alternatively, the mold cavity used for an over molding process used to mold third layer 482 to second layer 452 may include a geometry that allows third layer 482 (prior to curing) to flow in a manner forming first extension 492 and second extension 494. Also, first extension 492 and second extension 494 provide for additional surface area on which third layer 482 is molded to second layer 452, thereby promoting adhesion. Also, rather than forming or cutting parts or materials in a precise manner (e.g., within precise tolerances), the over molding process allows third layer 482 to simply flow around second layer 452. Further, the use of tool 430 removes the need to form an indention in first layer 402, thereby reducing the need to rely on precise tolerances. This allows parts to be formed as they may which reduces manufacturing times and associated costs.

Third extension 496 when secured to first layer 402 in a manner shown in FIG. 7 allows for improved functionality of case 400. For example, when an electronic device is positioned within case 400, the number of "false triggers" may be reduced when depressing protrusion 490 in order to press a control input, such as a button, of the electronic device. In other words, a force applied to protrusion 490 may be more directly transferred to first layer 402 as well as a control input (e.g., button) of the electronic device. Further, the force required to depress the control input within case 400 may be reduced. Also, although not shown, in some embodiments, adhesive layer 432 is positioned between first layer 402 and the extensions (e.g., first extension 492, second extension 494, and/or third extension 496).

Figure 8:
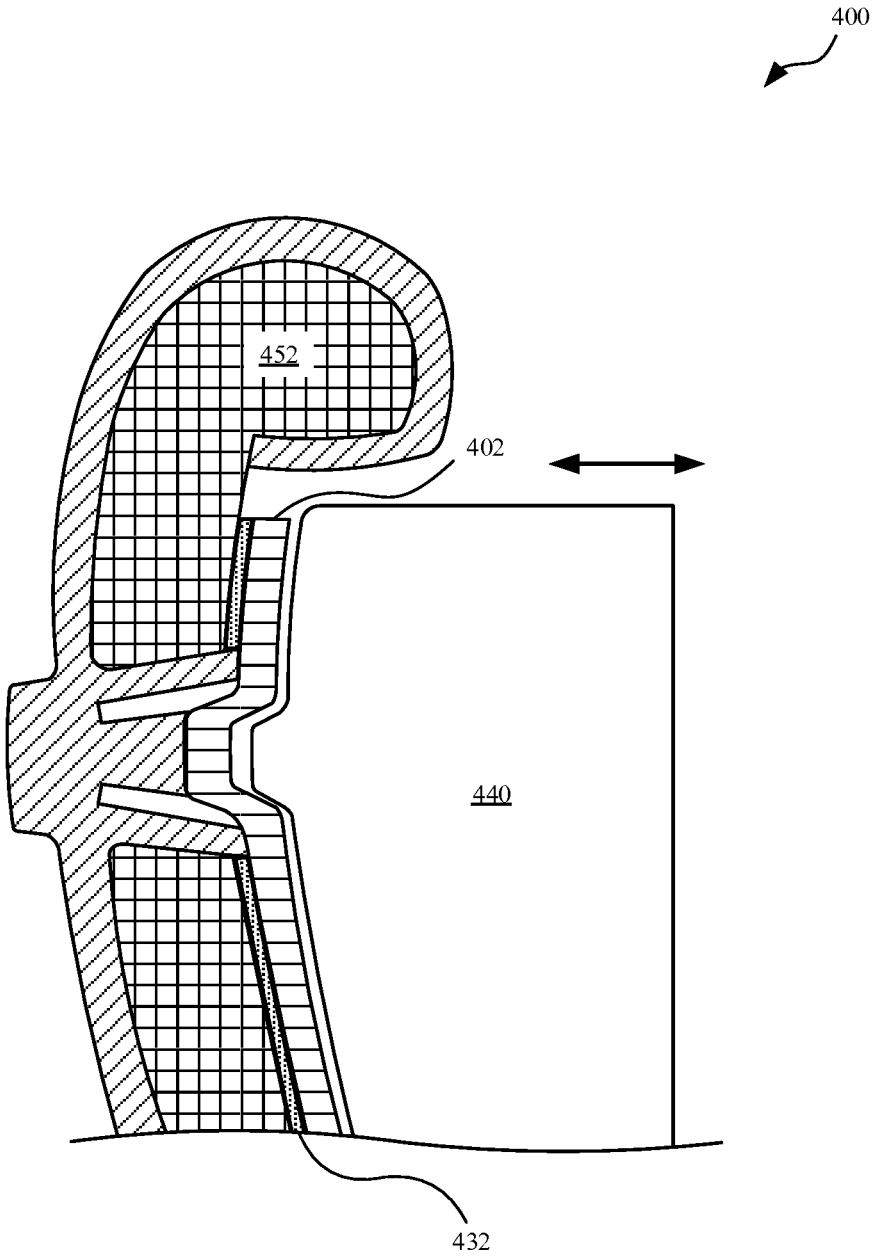
FIG. 8 illustrates a process by which a first layer of a case can be re-bonded to a second layer by a tool, in accordance with the described embodiments.

FIG. 8 illustrates a process by which a first layer of a case can be re-bonded to a second layer of the case by a tool in order to further secure the layers of the case, in accordance with the described embodiments. Tool 440 may be used to provide a re-bond operation of first layer 402 in order to ensure first layer 402 is adhesively secured to second layer 452. As shown, tool 440 may traverse in a direction toward and away from first layer 402. Tool 440 may engage first layer 402 to ensure first layer 402 engages adhesive layer 432, and both first layer 402 and adhesive layer 432 engage second layer 452. This ensures a good finish, particularly in instances of bonding to a non-linear surface.

Figure 9:
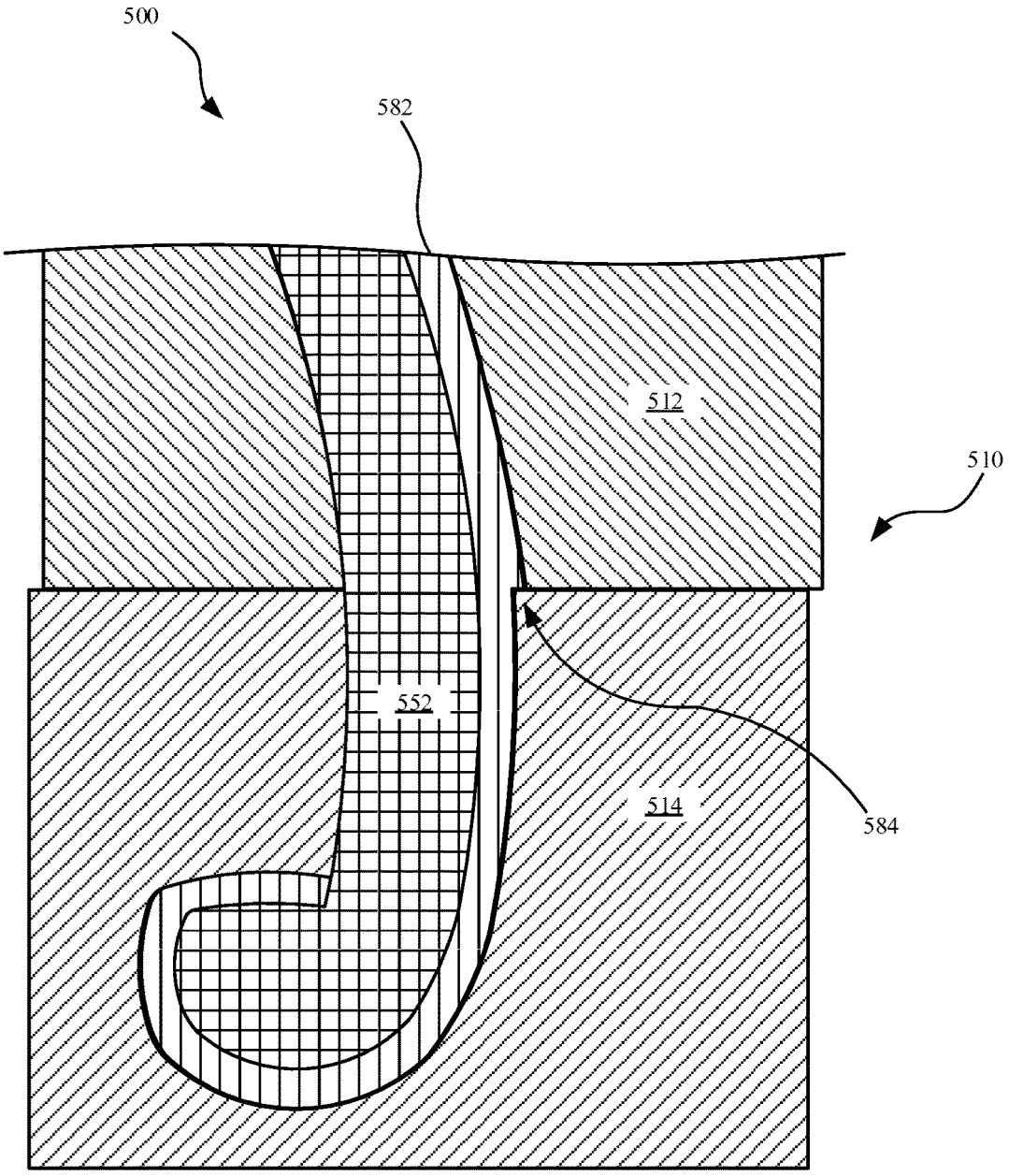
FIG. 9 illustrates a cross sectional view of an enlarged portion of an embodiment of a case positioned within a mold device.

FIG. 9 illustrates a cross sectional view of an enlarged portion of an embodiment of case 500 positioned within a mold device 510. Case 500 is shown upside down. In some embodiments, mold device 510 includes first mold member 512 and second mold member 514. In order to over mold third layer 582 to second layer 552, first mold member 512 engages second mold member 514. However, in some cases, it may be difficult align first mold member 512 to second mold member 514 with absolute precision. In other cases, first mold member 512 and second mold member 514 may be misaligned due to tolerances within first mold member 512 and/or second mold member 514. In either event, a mismatch can occur between first mold member 512 and second mold member 514. This mismatch may be on the order of approximately 100 micrometers. However, despite this relatively small mismatch, third layer 582, prior to curing, can flow into this mismatch area between first mold member 512 and second mold member 514, giving case 500 the appearance of a lip 584 which is generally undesirable. As a result, either a rework operation may be required, or alternatively, case 500, which also includes second layer 552 which has already been molded, may be discarded.

Figure 10:
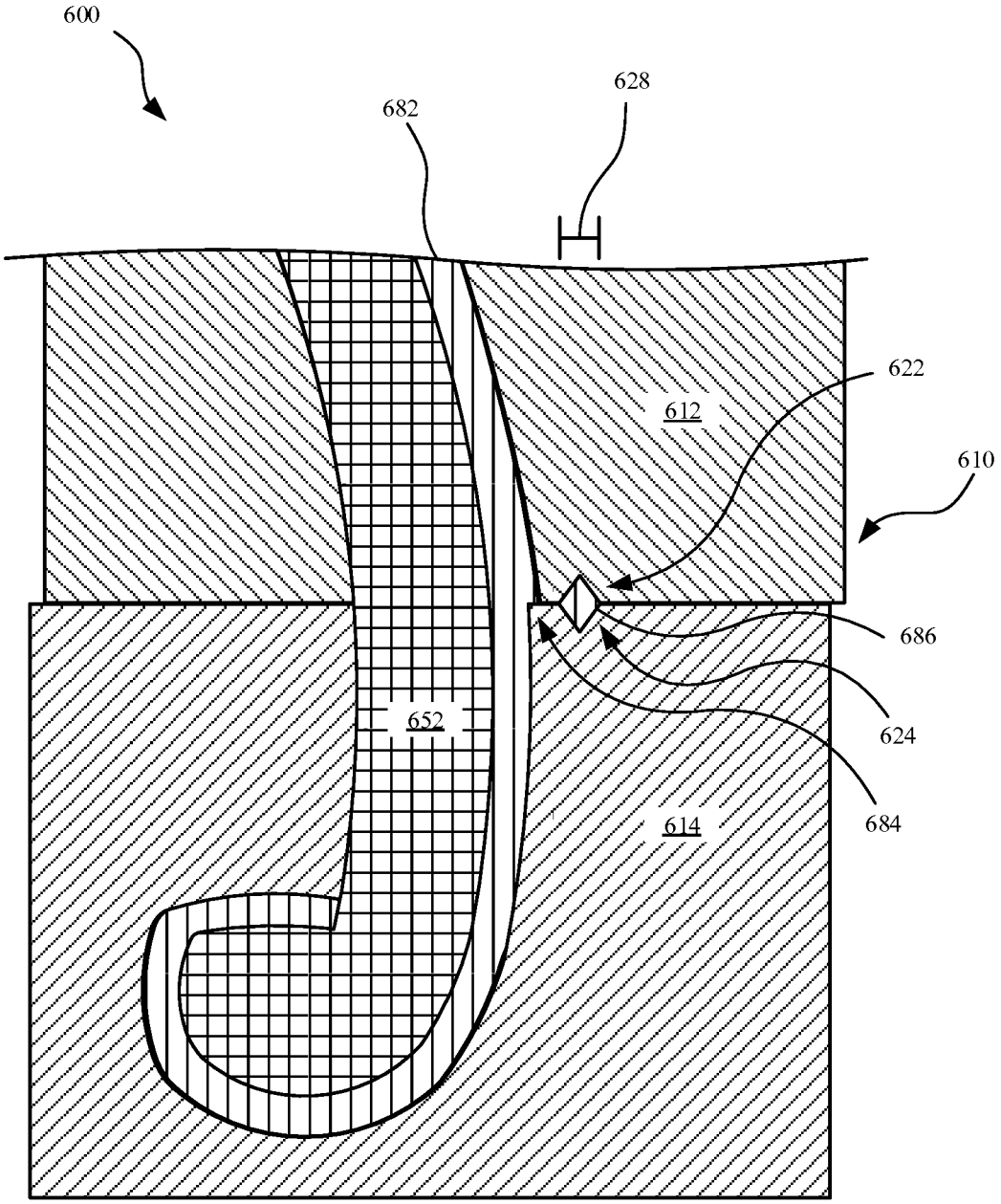
FIG. 10 illustrates an enlarged portion of an embodiment of a case in a mold device having void regions.
Figure 12:
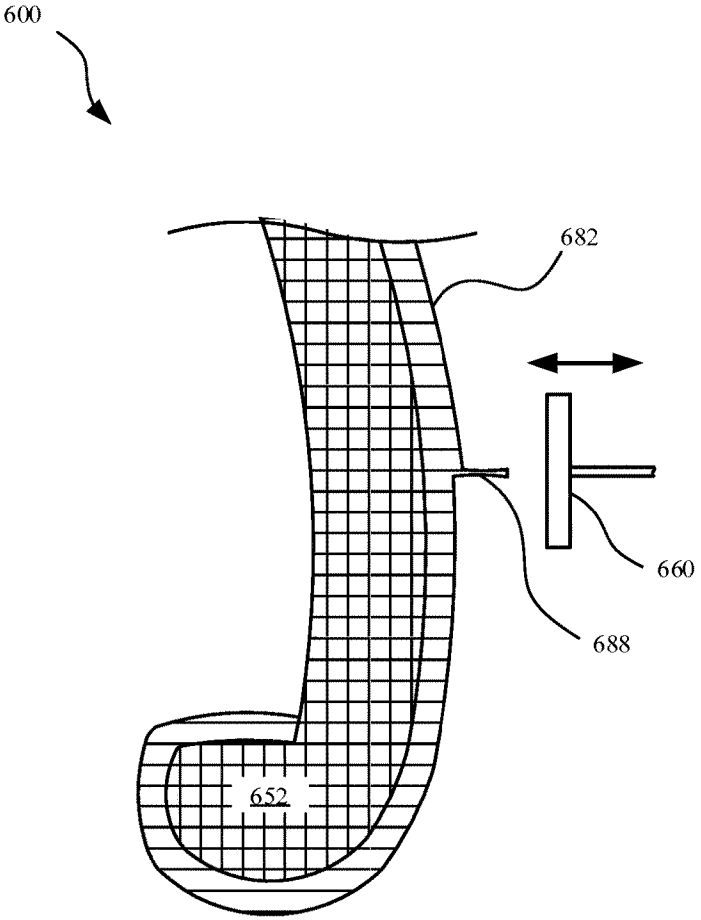
FIG. 12 illustrates the enlarged view shown in FIG. 11, with a portion of the extension removed.
Figure 11:
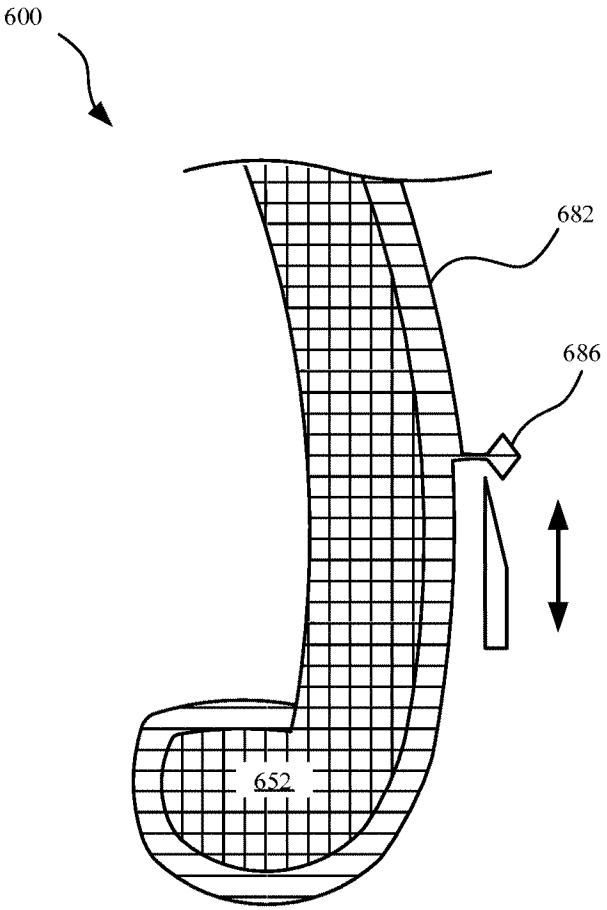
FIG. 11 illustrates the enlarged view of the case shown in FIG. 10, with the mold member removed.

FIGS. 10-12 illustrate an over molding process of an embodiment of case 600 in a modified mold device 610. FIG. 10 illustrates an enlarged portion of an embodiment of case 600 in mold device 610 having first mold member 612 and second mold member 614. Here, first mold member 612 and second mold member 614 include first void region 622 and second void region 624, respectively. First void region 622 and second void region 624 each may include a thickness 628 approximately in the range of 40 to 60 micrometers. In this manner, when an over molding process forms third layer 682 to second layer 652, third layer 682 can flow into first void region 622 and second void region 624. As a result, in addition to lip 684 forming around case 600, extension 686 is also formed. However, this technique provides a structure requiring relatively simple steps to remove. This technique is found to be advantageous when the mismatch between first mold member 612 and second mold member 614 is approximately 50 micrometers or less.

Figure 13:
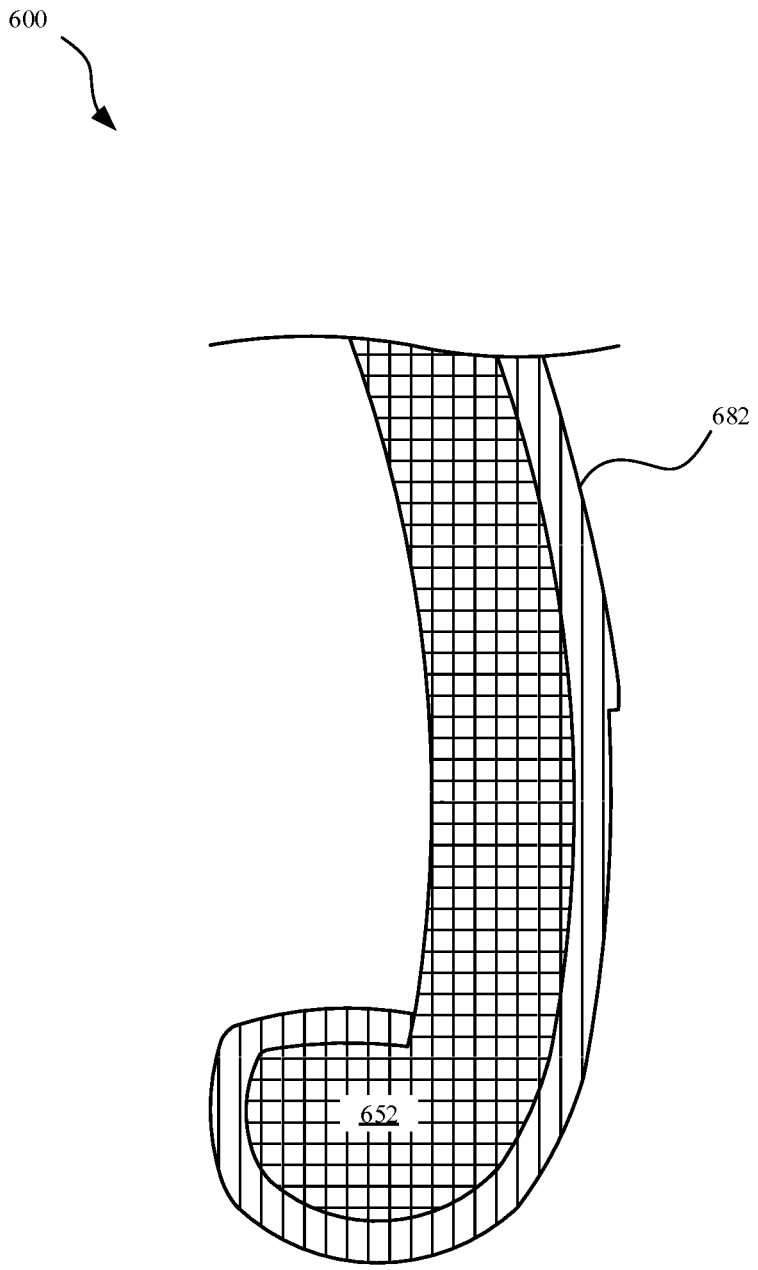
FIG. 13 illustrates the enlarged view of the case shown in FIG. 12, with the excess material removed from the third layer.

FIG. 11 illustrates the enlarged view of case 600 shown in FIG. 10, with the mold member removed. As a result of the first and void regions, excess material, such as extension 686, intentionally formed may be more easily removed. As shown, tool 650 may be used to remove extension 686. In some embodiments, tool 650 is a blade. FIG. 12 illustrates the enlarged view of case 600 shown in FIG. 11, with a portion of extension 686 removed. This remaining excess material 688 of third layer 682 may be referred to as "flash" material which may be removed by tool 660, such as a grinding or sanding tool. FIG. 13 illustrates the enlarged view of case 600 shown in FIG. 12, with the excess material removed from third layer 682. Any resultant portion evidencing a mismatch may be hidden or masked by subsequent processes.

Figure 14:
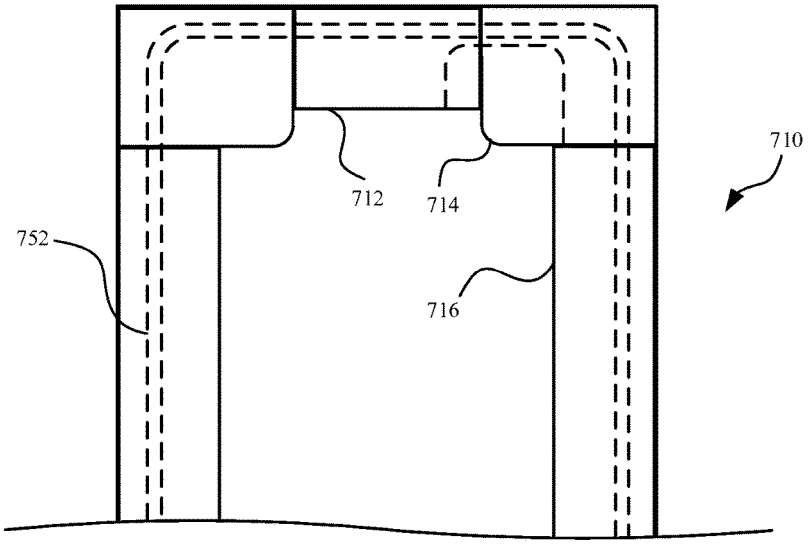
FIG. 14 illustrates an embodiment of a second layer positioned within a mold member.
Figure 15:
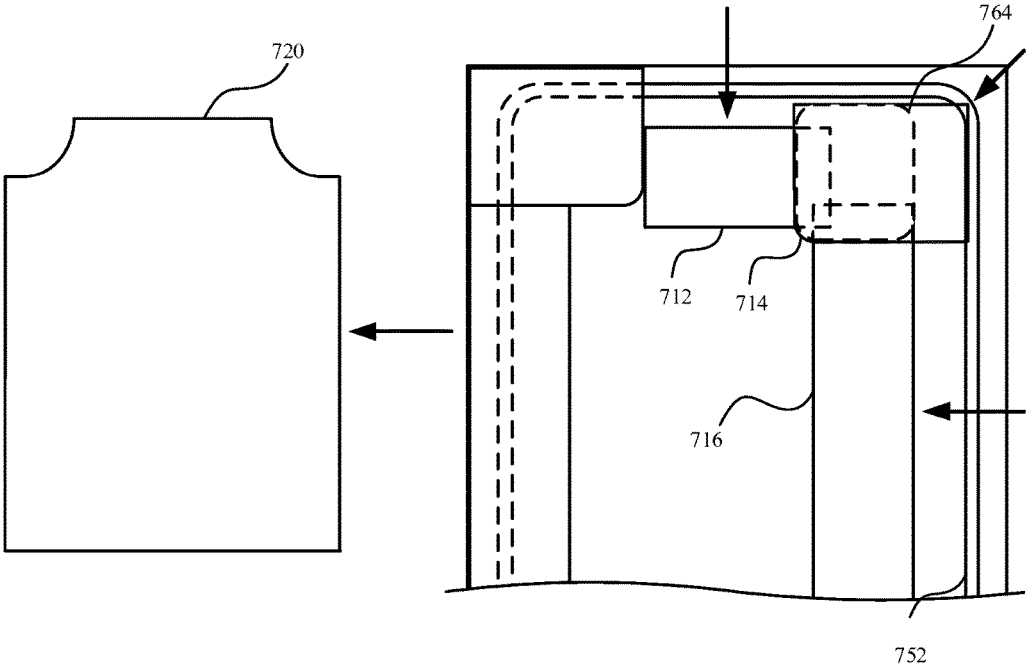
FIG. 15 illustrates a portion of a mold member removed from the second layer after a liquid (e.g., non-cured plastic) used to form the second layer is poured into mold member and cured.

FIGS. 14 and 15 illustrate a process for forming a recessed portion (such as recessed portion 264 shown in FIG. 2). FIG. 14 illustrates an embodiment of second layer 752 positioned within mold member 710. Mold member 710 may include first member 712, second member 714, and third member 716, which, when acting in concert, can form a recessed portion. FIG. 15 illustrates mold core 720 removed from second layer 752 after a liquid (e.g., non-cured plastic) used to form second layer 752 is poured into mold member 710 and cured. When mold core 720 is removed, first member 712, second member 714, and third member 716 are configured to extend inward toward a central region of second layer 752. As a result, an indention or bossed portion (not shown) below each of first member 712, second member 714, and third member 716 may force the liquid to traverse in a direction toward the central portion of second layer 752 to define recessed portion 764. When second layer 752 cures, first member 712, second member 714, and third member 716 may be removed from second layer 752 and recessed portion 764 remains. Forming recessed portion 764 in this manner has several advantages. For example, a material removal process, which may include a CNC tool, is not required which removes additional tolerance requirements. Also, a portion of recessed portion 764 may be formed on a portion of a sidewall of second layer 752. Conventional techniques for forming recessed portion 764, which may include a material removal tool, must fit into tight spaces, which may be cumbersome and difficult. However, using mold member 710, the liquid simply flows in all areas not occupied by the mold member 710, including first member 712, second member 714, and third member 716, making it easier to mold features into non-linear spaces.

Figure 16:
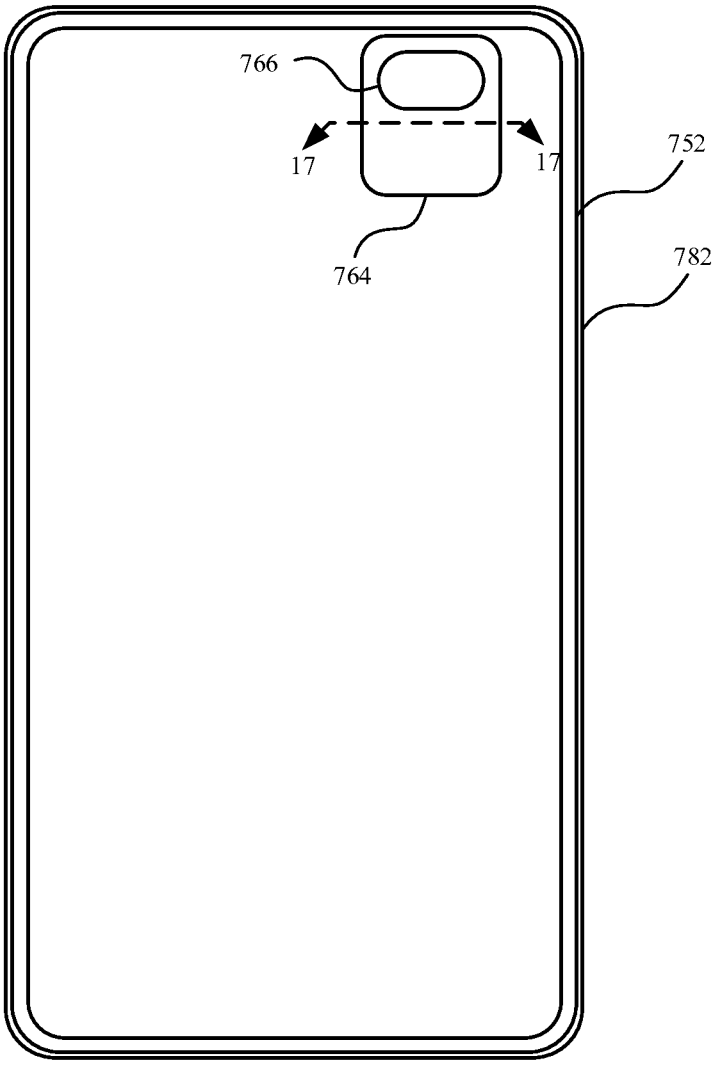
FIG. 16 illustrates a process for forming a recessed portion in the second layer during the formation (e.g., curing) of the second layer, in accordance with the described embodiments.
Figure 17:
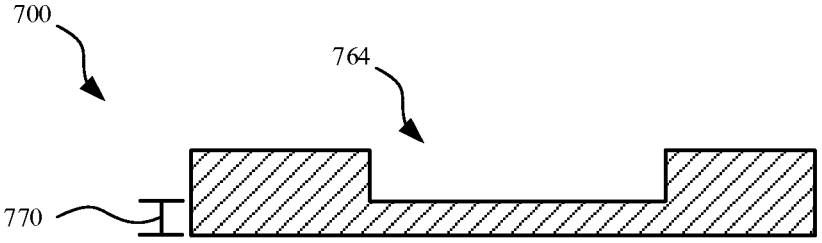
FIG. 17 illustrates a cross sectional view taken across the 17-17 line shown in FIG. 16.

After second layer 752, including recessed portion 764, is formed, third layer 782 is formed on second layer 752 in an over molding process previously described, as shown in FIG. 16. Also, case 700 may undergo a die cutting process to form apertures, such as aperture 766 within recessed portion 764. FIG. 17 illustrates a cross sectional view taken across the 17-17 line shown in FIG. 16. Recessed portion 764 may include a thickness 770 that depends on the electronic device being used with case 700.

Figure 18:
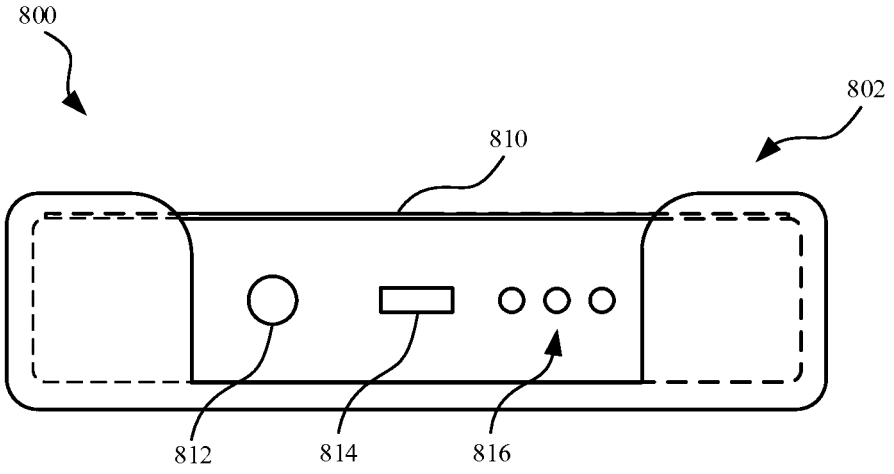
FIG. 18 illustrates a plan view of an embodiment of an electronic device positioned within a case, with the case allowing for access to various features of the electronic device.
Figure 19:
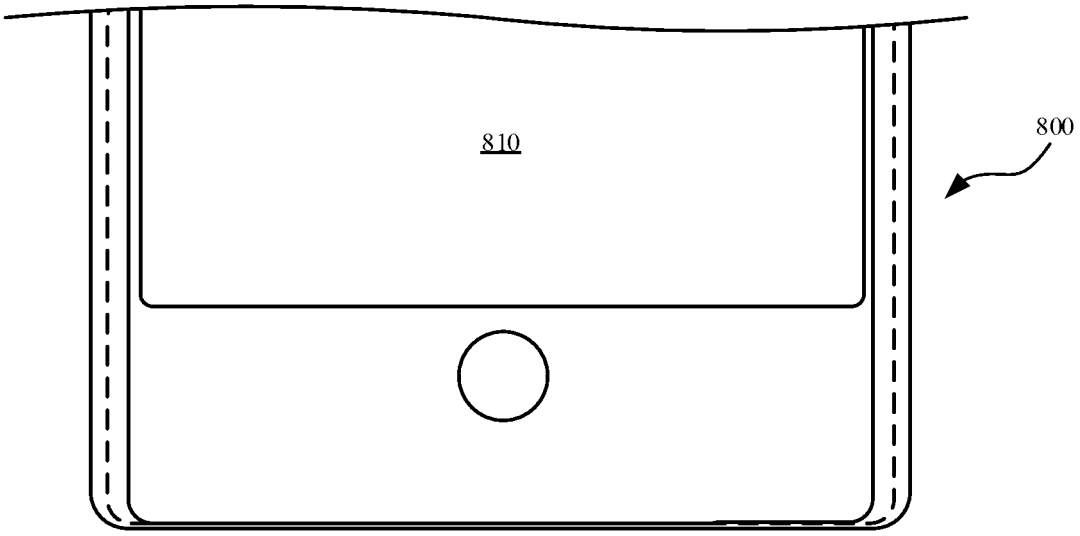
FIG. 19 illustrates a plan view of the embodiment of the electronic device in FIG. 18 positioned within the case.

FIGS. 18 and 19 illustrate a portion of electronic device 810 positioned within case 800. The features of case 800 described herein may be included in previous embodiments of a case. FIG. 18 illustrates a plan view of electronic device 810 positioned within case 800, with case 800 allowing for access to various features of electronic device 810. For example, case 800 may include a non-linear region 802 similar to a U-shape design that allows a user to plug in an accessory into first jack 812 and/or second jack 814. In addition, electronic device 810 may include speaker grill 816 configured to allow sound to escape electronic device 810. The non-linear region 802 of case 800 allows for sufficient retention of electronic device 810 within case 800 while not interrupting access to the device, or disrupting the sound emitted from the device.

FIG. 19 illustrates an alternate view of electronic device 810 positioned within case 800. From this view, the non-linear region (shown in FIG. 18) is generally not visible. Also, in some embodiments, a lower portion or edge of electronic device 810 is substantially co-planar, or flush, with respect to a lower portion of case 800.

Figure 20:
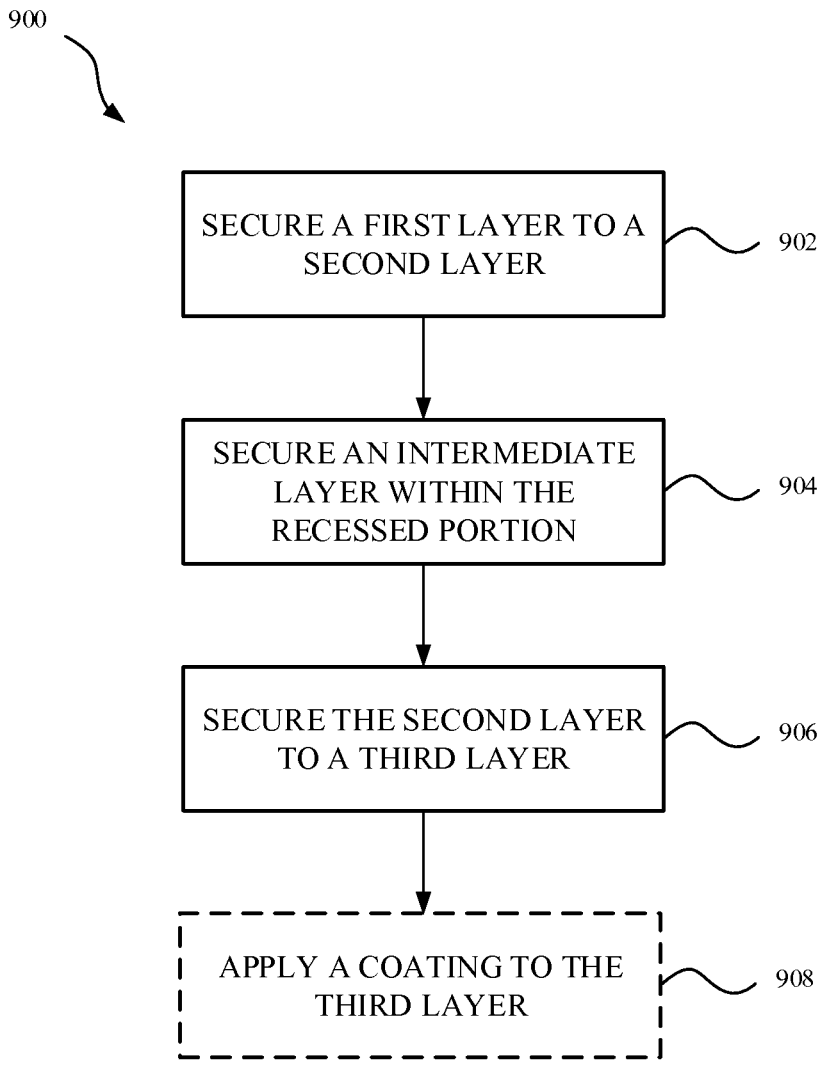
FIG. 20 illustrates a flowchart showing a method for forming a case for an electronic device, in accordance with the described embodiments.

FIG. 20 illustrates a flowchart 900 showing a method for forming a case for an electronic device, in accordance with the described embodiments. In step 902, a first layer is secured to a second layer. Securing means may include an adhesive layer. In some embodiments, the first layer includes a first aperture and the second layer includes a recessed portion and a second aperture within the recess portion. Also, in some embodiments, the second layer may further include a sidewall having a third aperture. In step 904, an intermediate layer is secured within the recessed portion. The intermediate layer may include a fourth aperture approximately concentric with respect to the first aperture and the second aperture. In step 906, the second layer is secured to the third layer. In some embodiments, the third layer includes a first protrusion and a second protrusion. In an optional step 908, a coating may be applied to the third layer. In some embodiments, the coating includes a combination of polyurethane and silicone, and may be referred to as a slip coat. The coating may be useful for several purposes, such as improving the feel of the case, reducing an accumulation or buildup of particulates of dust, lint, or other contaminants, and improving the resistance to abrasion.

Also, in some embodiments, the first protrusion and the second protrusion are positioned within the third aperture. In order to assemble the various layers together, an expandable member may be inflated or expanded to force the layers together. Also, some apertures of the second layer may include a relief configured to receive a portion of the third layer formed during an over molding process. Also, the first protrusion and/or the second protrusion may each include extensions that engage both the first layer and the second layer.

In another embodiment, a second layer may be molded by means such as injection molding. Then, a silicone layer is over molded to an exterior portion of the second layer. In some cases, prior to over molding the silicon layer, a coating or "primer" is added to the second layer in locations where the silicone layer is over molded to the second layer. Then, any additional, unwanted portions of the silicone layer (e.g., flash) may be removed. Then, a coating (previously described) is applied to the silicone layer. Then, a camera trim (e.g., intermediate layer) is adhesively secured to an interior portion of the second layer. Then, a microfiber layer (e.g., first layer) is adhesively secured to the interior portion of the second layer.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A case for an electronic device, the case comprising:

a first layer having an indented region;

a second layer attached with the first layer, the second layer comprising an opening, wherein the indented region is in a location corresponding to the opening; and a third layer attached with the second layer and comprising a protrusion, the third layer further comprising a first extension that extends from the protrusion and through the opening and engages the indented region, and a second extension and a third extension, the second extension and the third extension extending through the opening to engage the first layer.

2. The case as recited in claim 1, further comprising a fourth layer, wherein the first layer comprises a recessed portion that receives the fourth layer.

3. The case as recited in claim 2, wherein the first layer comprises a second opening in the recessed portion, and wherein the fourth layer comprises an opening concentric with respect to the second opening.

4. The case as recited in claim 3, wherein the second layer is fully covered by the first layer and the third layer.

5. The case of claim 1, wherein the second layer comprises a second opening and a cut out portion defined by a material removal region, the cut out portion surrounding the opening, and wherein the third layer extends through the second opening and into the cut out portion such that the third layer interlocks with the second layer.

6. The case of claim 1, wherein a force to the protrusion causes the extension to move toward the first layer at the indented region.

7. A case for an electronic device having a camera, the case comprising:

a first layer having a size and shape defining an interior region that is configured to receive the electronic device, the first layer having a first opening;

a second layer attached with the first layer, the second layer comprising a recessed portion in a location corresponding to the camera when the electronic device is inserted into the interior region, the recessed portion including a second opening; and an intermediate layer disposed in the recessed portion, the intermediate layer having a third opening, wherein the first opening, the second opening, and the third opening define a through hole.

8. The case of claim 7, further comprising a third layer attached with the second layer and defining an exterior region, the third layer having a fourth opening aligned with the first opening, the second opening and the third opening such that the through hole is further defined by the fourth opening that extends from the exterior region to the interior region.

9. The case of claim 8, wherein the second layer comprises a lip region that secures the electronic device, and wherein the third layer covers the lip region.

10. The case of claim 7, wherein the intermediate layer is covered by the first layer and the second layer.

11. The case of claim 7, wherein the intermediate layer is positioned around the camera, when the electronic device is positioned in the interior region, to block reflected light emitted from the electronic device when the camera captures an image.

12. A case for an electronic device, the case comprising:

a first layer;

a second layer having a rear wall and sidewalls that combine with the rear wall to define an internal cavity that receives the electronic device, the sidewalls having a lip region extending inward along the sidewall in a direction toward the internal cavity, the second layer further comprising an opening and a cut out portion, the cut out portion defined by a material removal region and surround the opening; and a third layer covering the sidewalls and the lip region, the third layer extending through the opening and into the cut out portion such that the third layer interlocks with the second layer, wherein the third layer covers an exterior portion of the sidewall and wraps around the lip region and terminates at an interior region of the sidewall.

13. The case of claim 12, wherein:

the second layer comprises a planar surface at the lip region, the third layer covers the planar surface to secure the second layer with the third layer.

14. The case of claim 12, wherein the second layer further comprises a second opening, and wherein the third layer comprises an extension that passes through the second opening and engages the first layer.

15. The case of claim 14, wherein the third layer further comprises a second extension and a third extension, the second extension and the third extension passing through the second opening and engaging the first layer.

16. The case of claim 12, further comprising an intermediate layer positioned in a recessed portion of the second layer, wherein:

the first layer includes a first opening, the second layer includes a second opening aligned with the first opening, the intermediate layer includes a third opening aligned with the second opening, and the first opening, the second opening, and the third opening define a through hole from the exterior region to the interior region.

17. A case for an electronic device, the case comprising:

a first layer having an indented region;

a second layer attached with the first layer, the second layer comprising an opening, wherein the indented region is in a location corresponding to the opening; and a third layer attached with the second layer and comprising a protrusion, the third layer further comprising an extension that extends from the protrusion and through the opening and engages the indented region, wherein the second layer comprises a second opening and a cut out portion defined by a material removal region, the cut out portion surrounding the opening, and wherein the third layer extends through the second opening and into the cut out portion such that the third layer interlocks with the second layer.

18. The case as recited in claim 17, wherein the third layer further comprises a second extension and a third extension, the second extension and the third extension extending through the opening to engage the first layer.

* * * * *